US005106024A

United States Patent [19]

Frene et al.

[11] Patent Number: 5,106,024

[45] Date of Patent: Apr. 21, 1992

[54] CONTROLLED FLOWRATE COATING PRODUCT SPRAYER INSTALLATION

[75] Inventors: André Frene, Vourey; Eric Prus, Grenoble; Caryl Thomé, Saint Egreve, all of France

[73] Assignee: Sames, S.A., Meylan, France

[21] Appl. No.: 576,450

[22] PCT Filed: Jan. 2, 1991

[86] PCT No.: PCTFR/90/00100 § 371 Date: Sep. 12, 1990 § 102(e) Date: Sep. 12, 1990

[30] Foreign Application Priority Data

Feb. 13, 1989 [FR] France ..... 8901821

[51] Int. Cl.[5] ..... B05B 12/14; B05B 5/16

[52] U.S. Cl. ..... 239/690; 239/703; 239/112; 239/124; 239/323

[58] Field of Search ..... 239/690, 703, 708, 112, 239/124, 323, DIG. 14; 417/339, 395

[56] References Cited

U.S. PATENT DOCUMENTS

| | | | |
|---|---|---|---|
| 3,937,400 | 2/1976 | Krause | 239/323 |
| 4,728,034 | 3/1988 | Matsumura et al. | 239/112 |
| 4,879,137 | 11/1989 | Behr et al. | 239/112 |
| 4,962,724 | 10/1990 | Prus et al. | 239/690 |

FOREIGN PATENT DOCUMENTS

| | | |
|---|---|---|
| 0265748 | 5/1988 | European Pat. Off. . |
| 0292778 | 11/1988 | European Pat. Off. . |
| 1343633 | 1/1974 | United Kingdom . |
| 2166982 | 5/1986 | United Kingdom . |

*Primary Examiner*—Andres Kashnikow
*Assistant Examiner*—Karen B. Merritt
*Attorney, Agent, or Firm*—Spensley Horn Jubas & Lubitz

[57] ABSTRACT

A coating product sprayer installation enabling a rapid change of coating product. The installation includes two parallel distribution branches each containing a piston or membrane type intermediate storage tank defining an actuation chamber actuated by a liquid, the branches being connected by means of valves between a coating product change unit and at least one coating product sprayer. The apparatus can be used advantageously for electrostatic spraying of conductive coating products.

19 Claims, 1 Drawing Sheet

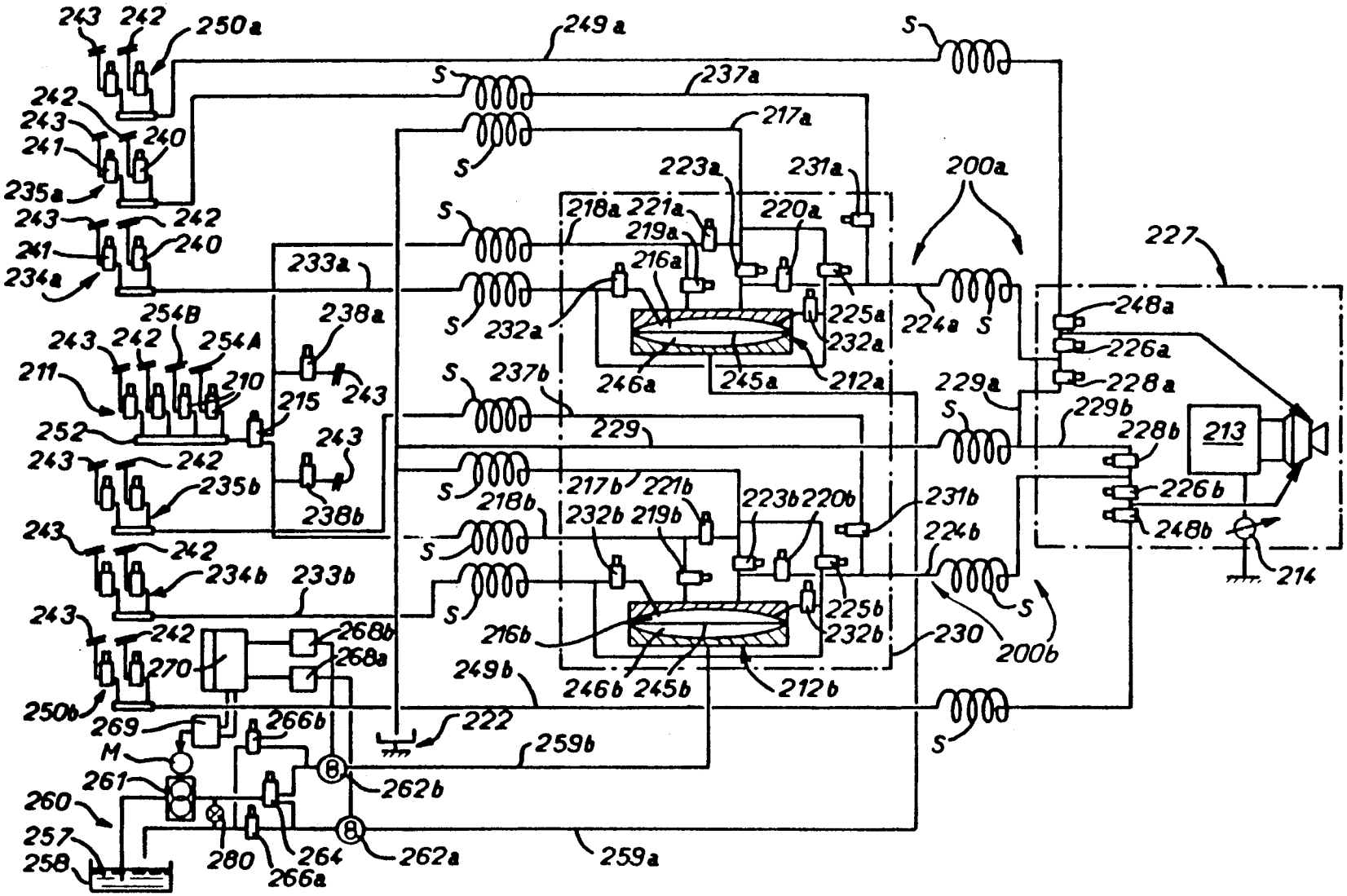
227
213
214
248a
226a
228a
229b
228b
226b
248b
200a
224a
229a
200b
231b
224b
230
231a
225a
232a
212a
220a
217a
237a
223a
221a
219a
216a
218a
245a
246a
229
225b
232b
220b
223b
212b
221b
219b
217b
232b
245b
246b
216b
218b
237b
232a
249a
259a
259b
249b
222
262b
262a
233a
238a
243
215
238b
233b
268b
268a
266b
264
266a
280
254A
210
254B
235b
234b
270
269
M
261
260
257
258
250a
242
240
241
235a
234a
211
252
250b

CONTROLLED FLOWRATE COATING PRODUCT SPRAYER INSTALLATION

BACKGROUND OF THE INVENTION

1. Field of the Invention

The invention concerns an installation for spraying a coating product such as a paint or a varnish at a controlled flowrate: it proposes improvements for controlling accurately the flowrate of said coating product during a spraying phase and the quantity stored without there being any risk of the coating product circulation means or the means for measuring the flowrate or the quantity stored being damaged by said product. It is more particularly concerned with an installation of this type enabling the coating product to be changed very quickly.

2. Description of the Prior Art

To coat objects satisfactorily by spraying a finely divided coating product, in particular automatically, it is desirable continuously to adapt the flowrate of the coating product feeding the sprayer to the surface area to be covered per unit time. For example, in the case of an automobile body moving at constant speed past sprayers that are fixed or scanned with a more or less complex motion, the flowrate of the coating products must be lower, other things being equal, when painting the door columns than when painting larger surfaces such as hoods or roofs, for example. Consequently, the paint flowrate should ideally be modifiable at will at any time during a spraying phase. Also, the quantity of paint needed to paint a given object may vary according to the color of the paint. In a known color changing system in which the quantity of paint needed to paint one object or a group of objects a particular color is stored temporarily in an intermediate storage tank, the twofold problem usually arises of monitoring the paint flowrate during the spraying phase and of metering the necessary quantity of paint to be fed into the intermediate storage tank before the spraying phase.

This type of installation with intermediate storage tank(s) constitutes an attractive solution in the case of electrostatic application of electrically conductive coating products, such as certain metallic paints or water-based paints. It is then easier to insulate electrically the intermediate storage tank and the sprayer from other subsystems that are necessarily grounded during a spraying phase in which the sprayer is necessarily at a high voltage.

Numerous installations with intermediate storage tank(s) for electrostatic or other application are known. French patent application No 2 572 662 may be cited by way of example.

In this kind of context it is possible to control the flowrate of the coating product and its variations and also, where applicable, the metering of the coating product fed into an intermediate storage tank, using a computer. The flowrate monitoring and/or metering means must offer high performance and must be reliable. When these means (pumps, flowrate regulators, flowrate sensors, etc) are inserted into coating product circulation circuits they must offer very high performance, and are therefore expensive, if the required reliability and durability are to be achieved. The following phenomena are particularly relevant:

The product to be sprayed may be abrasive and/or chemically aggressive. Consequently, precision devices for metering and monitoring the flowrate such as pumps, gear-type sensors and pressure regulators must be capable of resisting the action of such products.

The product to be sprayed may be a non-Newtonian liquid (this is the case with some water-based paints in particular). In this case monitoring the flowrate by monitoring the pressure on the upstream side of a calibrated nozzle is not possible. Other means must therefore be used, such as pumps and/or gear-type sensors, which are particularly sensitive to the nature of the product flowing through them (in particular its abrasive characteristics). The problem becomes difficult to solve when it is required to implement electrostatic application of a water-based paint with fast color changes as one is faced simultaneously with problems of metering, insulation and the use of a relatively abrasive product.

SUMMARY OF THE INVENTION

The invention proposes a generally satisfactory solution to all these problems through integrating a particular type of intermediate storage tank into an installation designed to enable the coating product to be changed very quickly, which is an absolute necessity in some industries, in particular the automobile industry. The invention makes it possible to avoid contact of vulnerable control or measuring devices in an installation of this kind with the coating product by placing them in a flowrate and/or metering control hydraulic circuit associated with each intermediate storage tank.

To be more precise, the invention therefore concerns a coating product sprayer installation comprising at least one sprayer of said product facing a location or path of an object to be coated and intermediate storage tanks each adapted to receive a predetermined quantity of product and connected to feed said sprayer, characterized in that it comprises two coating product distribution branches connected in parallel between a coating product change unit and said sprayer and each incorporating an aforementioned intermediate storage tank and in that each intermediate storage tank encloses a mobile or deformable wall separating two adjacent chambers, a coating product chamber in the corresponding branch between said color change unit and said sprayer and an actuation chamber filled with a controllable volume of liquid by virtue of being connected t controlled flowrate feed means for said liquid.

The installation as defined above is particularly suitable for electrostatic spraying of a conductive coating product such as a water-based paint.

The invention will be better understood and other advantages of the invention will emerge more clearly from the following description of an installation in accordance with the invention given by way of example only and with reference to the drawing in which:

BRIEF DESCRIPTION OF THE DRAWINGS

The single figure is a schematic of a coating product sprayer installation embodying improvements in accordance with the invention.

DESCRIPTION OF THE PREFERRED EMBODIMENTS

The installation includes a known coating product change unit 211, also called a color change unit, and at least one electrostatic sprayer 213 insulated from ground and connected to a variable and/or interruptible high voltage supply 214 which can be switched out of service when the product is not being sprayed.

The installation comprises two similar distribution branches 200a, 200b each incorporating a respective intermediate storage tank 212a, 212b. The two branches are arranged in parallel between the coating product change unit 211 and the electrostatic sprayer 213.

In the remainder of the description analogous parts in both distribution branches have the same reference numbers with the respective suffix a or b.

Each intermediate storage tank 212a, 212b includes a variable volume coating product chamber 216a, 216b between the outlet from the color change unit 211 and the electrostatic sprayer 213. In the example shown the sprayer 213 is of the known "rotating bowl" type. It has two nozzles directed towards the rotating part which project the coating product into said rotating part. The two nozzles are parts of the two distribution branches mentioned above.

Each intermediate storage tank is connected to the color change unit by an insulative material pipe 218a, 218b , and a selectively operable valve 219a , 219b immediately adjacent the intermediate storage tank and controlling the feeding of the coating product into the corresponding chamber 216a, 216b. An outlet from this chamber is connected to the sprayer by a selectively operable valve 220a, 220b immediately adjacent the corresponding intermediate storage tank and an insulative material pipe 224a, 224b. Selectively operable valves 226a, 226b are inserted between the respective pipes 224a, 224b and the sprayer 213. A further selectively operable valve 221a, 221b is connected between each respective pipe 218a, 218b and an insulative material evacuation pipe 217a, 217b. The valves 221a, 221b are adjacent the respective valves 219a, 219b. The two evacuation pipes discharge into a common pipe connected to grounded purge means 222. The valves 226a, 226b are immediately adjacent the sprayer and mounted on a common assembly 227 with the sprayer which is insulated from ground. The end of each pipe 224a, 224b connected to the valve 226a, 226b is also connected to the purge means 222 via a selectively operable valve 228a, 228b carried by the assembly 227 and a respective insulative material pipe 229a, 229b. These two pipes meet at a common pipe 229 connected to the above-mentioned purge means 222. The two intermediate storage tanks 212a, 212b are part of a system 230, in this instance fixed in position, which is electrically insulated from ground. The two intermediate storage tanks are also insulated from each other. The valves 219, 220 and 221 are also part of this insulated system as are selectively operable cleaning product valves 232a, 232b. The valves 232a (of which there are two in this instance) associated with the storage tank 212a have their inlets interconnected and fed by the same cleaning unit 234a (external to this system and grounded) via an insulative material pipe 233a. Likewise the valves 232b associated with the intermediate storage tank 212b have their inlets interconnected and fed by the same cleaning unit 234b via an insulative material pipe 233b. The valves 232 are connected to respective injectors discharging into the corresponding coating product chamber 216 at appropriate locations and with appropriate orientations. Each of these valves inserted in this way between a cleaning unit 234a or 234b and an injector is in this instance mounted directly on the side of the intermediate storage tank casing, immediately adjacent the corresponding injector. An evacuation valve 223a, 223b is connected between the chamber 216a, 216b and the evacuation pipe 217a, 217b, respectively. A branch valve 225a, 225b is connected between the common inlets of the valves 232a, 232b and the evacuation pipe 217a, 217b, respectively. Each cleaning unit 234a, 234b and others to be mentioned later include selectively operable connection means, constituted in this instance by valves 240, 241, adapted to place successively and sequentially in communication with the chamber 216 (via the pipe 233) either a pressurized cleaning product circulation circuit 242 or a compressed air distribution circuit 243. In the case of a water-based paint the cleaning product may be water to which alcohol is added.

Each intermediate storage tank 212a, 212b encloses a mobile wall consisting of a disc-shaped deformable membrane 245a, 245b dividing the interior space of the intermediate storage tank into two adjacent chambers, namely the coating product chamber 216a, 216b with which the valves 219, 220, 223 and 232 communicate and a respective actuation chamber 246a, 246b the function of which will be discussed later. Each of the chambers 216 and 246 is in the shape of a spherical dome when the membrane is in its median position in the absence of any loading, as shown in the drawing. The radius of curvature of the fixed wall of each chamber is determined such that the membrane can be applied against this wall, if necessary, and so reduce the volume of said chamber to a virtually zero residual value. The two injectors are substantially diametrally opposed and discharge into the chamber 216 along the perimeter of the membrane and adjacent the latter. They may be oriented approximately tangentially. Their role is to create turbulent movement of air and/or cleaning product in the chamber 216 to achieve fast and effective cleaning.

A selectively operable valve 231a, 231b adjacent the valve 220a, 220b is connected between the pipe 224a, 224b and a cleaning unit 235a, 235b via an insulative material pipe 237a, 237b, respectively. The sprayer 213 can be put into communication with a cleaning unit 250a by a selectively operable valve 248a and an insulative material pipe 249a. The valve 248a is connected to the outlet of the valve 226a immediately adjacent the latter. Likewise, the sprayer 213 can be put into communication with a cleaning unit 250b by a selectively operable valve 248b and an insulative material pipe 249b. The valve 248b is connected to the outlet of the valve 226b immediately adjacent the latter. The valves 248a, 248b are carried by the insulative assembly 227. The cleaning units 250a, 250b are therefore more specifically assigned to cleaning the sprayer 213, alternately, during successive color change cycles.

In the known manner, the coating product change unit 211 includes a set of selector valves 210 for putting its outlet manifold 252 (connected to the pipes 218a, 218b by a three-way valve 215) into communication with one of the following circuits:

A coating product circulation circuit 254A, 254B each circuit corresponding to a given color, or The cleaning product circulation circuit 242, or the compressed air distribution circuit 243.

Selectively operable drying valves 238a, 238b are connected between the compressed air distribution circuit 243 and each outlet of the three-way valve 215, respectively.

At least one of the insulative material pipes connecting the color change unit 211 or a cleaning unit 234, 235, 250 to the insulated system 230 advantageously includes a serpentine configuration section S. In the example described a serpentine section of this kind is provided in each of the pipes 218, 233, 237 and 249. Similar serpentine sections S are provided in the pipes 217 and 229 providing the return connection to the purge means 222 and in the pipes 224 connecting the intermediate storage tanks to the sprayer. Each serpentine section S is preferably oriented so that its axis is substantially horizontal. This prevents the formation of a continuous film of liquid inside the pipe when it is not full. In this way the electrical "path" is cut at each loop and the residual liquid droplets are "trapped" until they evaporate completely in the substantially horizontal paths of the serpentine section. To speed up drying means are provided for blowing air continuously through the aforementioned insulative material pipes during at least part of the time in which the high voltage is applied to one or other of the distribution branches 200*a*, 200*b* via the sprayer 213 at the high voltage and the conductive coating product. This is achieved by leaving some of the valves described above open to allow the air to circulate in the pipes between the air distribution circuit 243 and the purge means 222.

The actuation chamber 246*a*, 246*b* of each intermediate storage tank 212*a*, 212*b* is filled with a variable quantity of actuation liquid through controlled flowrate feed means 260. These feed means include a storage tank 258 for storing the actuation liquid 257, a pump 261 connected between the storage tank and the inlet of a three-way valve 264 and two insulative material pipes 259*a*, 259*b* respectively connected to the outlets of the three-way valve 264. These two pipes discharge into the actuation chambers 246*a*, 246*b*, respectively. Flowrate sensors 262*a*, 262*b* are respectively inserted into the pipes 259*a*, 259*b*. These are "positive (not visible in the displacement" sensors whose structure is very similar to that of a gear pump. The pump 261 is preferably a positive displacement pump also, such as a gear pump. It is driven by a self-regulated synchronized motor M and protected against pressure surges by a limiter 280. Selectively operable return valves 266*a*, 266*b* are respectively connected between each outlet from the three-way valve 264 and the storage tank 258. The feed means 260 and the storage tank 258 are grounded. The liquid 257 is a Newtonian insulative liquid such as oil so that no special precautions are needed with regard to electrical insulation between said feed means, the storage tank 258 and the intermediate storage tanks 212.

The installation also includes means for controlling the flowrate of liquid when the latter flows towards one of the chambers 246*a*, 246*b*. These control means include the sensors 262*a*, 262*b* and control the pump 261. They comprise transducers 268*a* , 268*b*respectively connected to the sensors 262*a*, 262*b* and supplying electrical signals for processing, a comparator 269 and a computer 270. The comparator set point signal is produced by the computer. The output of the comparator 269 is connected to a control input of the motor M which drives the pump 261. The signals supplied by the sensors 262*a*, 262*b* are selected alternately by the computer and applied to the comparator 269. The flowrate sensors 262*a*, 262*b* operate irrespective of the direction of flow of the actuation liquid in the respective pipes 259*a*, 259*b*. In the direction corresponding to filling of a chamber 246 the sensor is part of the pump flowrate control system. In the opposite flow direction it measures only the quantity of liquid returning to the storage tank 258, which makes it possible to determine at any time the volume of coating product introduced into the corresponding chamber 216. The computer 270 also controls the sequencing of all the valves in the installation and selects the transducer 268*a* or 268*b* according to whether the actuation chamber 246*a* or 246*b* is to be filled. Thus the computer 270 may hold and/or receive all data needed to determine the law of variation of the coating product flowrate when it passes to the sprayer 213, by controlling the filling of the corresponding actuation chamber 246*a*, 246*b*. When the coating product is admitted into an intermediate storage tank the computer controls the filling of the chamber 216*a*, 216*b* by controlling the opening of the valves 266*a*, 266*b*,of the valve 210 and of the corresponding valves 219*a*, 219*a* and the setting of the three-way valve 264 and by monitoring the quantity of coating product introduced into a chamber 216 by measuring the quantity of actuation liquid returning to the storage tank.

The operation of the installation that has just been described will now be described.

As already mentioned, the computer 270 is programmed to control the sequencing of all the valves in a manner that will now be described.

Assume that the sprayer 213 is being fed with the coating product in the intermediate storage tank 212*b*. In this case the valves 232*b*, 219*b* and 223*b* are closed. The valves 220*b* and 226*b* are open. The pump 261 feeds the actuation liquid into the pipe 259*b* through the three-way valve 264 and the flowrate sensor 262*b*. The coating product is therefore fed into the pipe 224*b* and the actuation chamber 246*b* is filled with actuation liquid. The coating product is therefore applied by the electrostatic sprayer 213, which is at the high voltage. During this time another coating product delivered by the product change unit 211 flows through the three-way valve 215 into the pipe 218*a*. The coating product is fed into the chamber 216*a* through the open valve 219*a*. At the same time the actuation liquid is expelled from the chamber 246*a* and returned to the storage tank 258 through the flowrate sensor 262*a* and the valve 266*a*. During this time insulation is maintained in the pipe 218*b* by circulation of air from the open valve 238*b* to the purge means 222, the valve 221*b* being open.

Towards the end of the period of use of the intermediate storage tank 212*b* and when a predetermined quantity of coating product has been introduced into the intermediate storage tank 212*a*, the valve 219*a* is closed and cleaning product followed by air flow in the pipe 218*a* from the coating product change unit to the purge means 222, the valve 221*a* being open.

While there is no product to be painted in front of the sprayer 213 the latter is cleaned and dried by means of the cleaning unit 250*b* and the pipe 249*b*, the valve 248*b* being open and the valve 226*b* being closed. At the same time the pipe 224*b* is cleaned by means of the cleaning unit 235*b*, the cleaning product and the air flowing successively through the pipe 237*b* and the valve 231*b*, the valve 228*b* being open towards the purge means. At the same time the new coating product begins to flow through the pipe 224*a* because actuation liquid is introduced into the chamber 246*a*, the valve 226*a* being open and the two valves 248*a* and 228i a being closed.

When the high voltage is applied again spraying of the new coating product can begin immediately, the pipe 218*a* being maintained insulated by flow of air through the valves 238*a* and 221*a*, the valve 219*a* being closed. At the same time the intermediate storage tank 212*b* is cleaned, being insulated from the high voltage from this time. This cleaning is performed by means of the cleaning unit 234*b*, the valves 232*b* and 223*b* being the only valves open, to enable the alternate circulation of cleaning product and air.

While the sprayer 213 is still being fed with coating product from the intermediate storage tank 212*a* a new coating product is introduced into the intermediate storage tank 212*b*. This coating product flows from the coating product coating change unit 211 through the three-way valve 215 and the pipe 218*b*, the valve 219*b* being open. The actuation liquid is returned to the storage tank 258 via the pipe 259*b*, the flowrate sensor 262*b* and the valves 266*b*, 219*b* and 210. When a predetermined quantity of actuation liquid has been returned to the storage tank (as measured by the flowrate sensor 262*b*) the computer closes the valve 266*b* the valve 219*b* and the corresponding valve 210. The intermediate storage tank 212*b* is then full and ready for use. At this time cleaning of the pipe 218*b* begins from the coating product change unit 211, the valve 221*b* being open.

When there is again no object to be painted in front of the sprayer the high voltage is disconnected and cleaning of the sprayer begins through the pipe 249*a* and cleaning of the pipe 224*a* from the cleaning unit 235*a*. Actuation liquid is injected into the chamber 246*b* of the intermediate storage tank 212*b* to start feeding the new coating product to the sprayer. The valves 248*a* and 228*a* are closed and the sprayer 213 is ready to paint a new object using coating product from the intermediate storage tank 212*b*. The same operations are then carried out in the same order as described above.

We claim:

1. A coating product sprayer installation comprising at least one sprayer (213) of said product facing a location or path of an object to be coated and intermediate storage tanks each adapted to receive a predetermined quantity of product and connected to feed said sprayer, characterized in that it comprises a coating product change unit for selectively supplying any one of a plurality of coating products, and two coating product distribution branches (200*a*, 200*b*) connected in parallel between said coating product change unit (211) and said sprayer (213) and each incorporating one said intermediate storage tank (212*a*, 212*b*)and in that each intermediate storage tank enclosed a mobile wall (245*a*, 245*b*) separating two adjacent chambers, a coating product chamber in the corresponding branch between said coating product change unit and said sprayer and an actuation chamber (246*a*,246*b*) filled with a controllable volume of liquid (257) by virtue of being connected to controlled flowrate feed means (260) for said liquid.

2. A coating product sprayer installation according to claim 1 in which said sprayer is connected to a variable high voltage supply, characterized in that said coating product change unit is connected to said two intermediate storage tanks via insulative material pipes (218*a*, 218*b*).

3. A coating product sprayer installation according to claim 2 characterized in that a coating product outlet of each intermediate storage tank (212) is connected to said sprayer by a respective insulative material pipe (224*a*, 224*b*) via selectively operable valves (220*a*, 220*b*, 226*a*, 226*b*) respectively adjacent said intermediate storage tank and said sprayer.

4. A coating product sprayer installation according to claim 2 characterized in that each actuation chamber (246*a*, 246*b*) is connected to a pump (261) by one respective second insulative material pipe (259*a*, 259*b*)and at least one selector valve (264), said pump being connected between said second pipes and an insulative actuation liquid storage tank.

5. A coating product sprayer installation according to claim 4 characterized in that said selector valve is a three-way valve the two outlets from which are respectively connected to said second pipes (259*a*,259*b*).

6. A coating product sprayer installation according to claim 5 characterized in that flowrate sensors (262*a*, 262*b*) are inserted into said two second pipes (259*a*259*b*), respectively, and in that it further comprises control means for said pump (261) including said two flowrate sensors.

7. A coating product sprayer installation according to claim 6 characterized in that said pump (261) is a positive displacement pump driven by a motor controlled by said control means.

8. A coating product sprayer installation according to claim 7 wherein said positive displacement pump is a gear pump.

9. A coating product sprayer installation according to claim 4 characterized in that selectively operable return valves (266*a*,266*b*) are connected between said second pipes (259*a*, 259*b*) and said actuation liquid storage tank (258).

10. A product sprayer installation according to claim 2 for electrostatically spraying conductive coating products characterized in that it comprises cleaning units (235*a*, 235*b*) respectively connected by respective insulative material pipes (237*a*,237*b*) to pipes (224*a*, 224*b*) connecting outlets from said intermediate storage tanks to said sprayer, the connection being made adjacent the intermediate storage tank outlets via selectively operable valves.

11. A coating product sprayer installation according to claim 2 characterized in that it comprises cleaning units (234*a*, 234*b*) respectively connected by respective insulative material pipes (233*a*, 233*b*) to said coating product chambers (216*a*, 216*b*) via selectively operable valves (232*a*, 232*b*) adjacent said intermediate storage tank. connected by respective insulative material pipes (233*a*, 233*b*) to said coating product chambers (216*a*, 216*b*) via selectively operable valves (232*a*, 232*b*) adjacent said intermediate, storage tank.

12. A coating product sprayer installation according to claim 11 characterized in that said valves (232*a*, 232*b*) are respectively connected to injectors discharging into the corresponding coating product chamber (216*a*, 216*b*) at appropriate locations and with appropriate orientations.

13. A coating product sprayer installation according to claim 12 characterized in that each of said valves is mounted direct on the side of the corresponding intermediate storage tank casing immediately adjacent the corresponding injector.

14. A coating product sprayer installation according to claim 2 characterized in that it comprises cleaning units (250*a*, 250*b*) respectively connected to said sprayer by respective insulative material pipes (249*a*, 249*b*) via selectively operable valves (248*a*, 248*b*) immediately adjacent said sprayer.

15. A coating product sprayer installation according to claim 2 characterized in that an insulative material evacuation pipe (217*a*, 217*b*) is connected between a corresponding intermediate storage tank and grounded purge means (222) via a corresponding evacuation valve (223*a*, 223*b*).

16. A coating product sprayer installation according to claim 2 characterized in that at least one said insulative material pipe incorporates a serpentine configuration section (S) which has a substantially horizontal axis.

17. A coating product sprayer installation according to claim 2 characterized in that it comprises means for blowing air into the said insulative material pipes during at least part of the time for which the high voltage is applied to said sprayer.

18. A coating product sprayer installation according to claim 1 characterized in that said mobile wall of each intermediate storage tank is a deformable membrane (245*a*, 245*b*).

19. A coating product sprayer installation according to claim 1 further comprising two flowrate sensors each connected between said controlled flowrate feed means and said actuation chamber of a respective one of said intermediate storage tanks.

* * * * *